US007605545B2

(12) United States Patent
Bai et al.

(10) Patent No.: US 7,605,545 B2
(45) Date of Patent: Oct. 20, 2009

(54) CONTROL SYSTEM FOR MULTIPLE FLUORESCENT LAMPS

(75) Inventors: Shwang-Shi Bai, Tainan (TW); Yu-Pei Huang, Tainan (TW); Shen-Yao Liang, Tainan (TW)

(73) Assignee: Himax Technologies Limited (TW)

( * ) Notice: Subject to any disclaimer, the term of this patent is extended or adjusted under 35 U.S.C. 154(b) by 400 days.

(21) Appl. No.: 11/532,678

(22) Filed: Sep. 18, 2006

(65) Prior Publication Data

US 2008/0068203 A1 Mar. 20, 2008

(51) Int. Cl.
*H05B 37/02* (2006.01)

(52) U.S. Cl. ..... 315/291; 315/247; 315/307

(58) Field of Classification Search ..... 315/194, 315/246–247, 291, 294, 299, 301, 307–308, 315/312; 363/9, 36, 155–156
See application file for complete search history.

(56) References Cited

U.S. PATENT DOCUMENTS 3,946,273 A * 3/1976 Goddard ..... 315/297
5,438,242 A * 8/1995 Simpson ..... 315/219
5,578,908 A * 11/1996 Persson ..... 315/307
6,707,264 B2 3/2004 Lin
6,778,415 B2 8/2004 Lin
6,879,114 B2 4/2005 Jales
7,397,195 B2 * 7/2008 Yu et al. ..... 315/194
7,414,371 B1 * 8/2008 Choi et al. ..... 315/291
7,436,130 B2 * 10/2008 Komatsu et al. ..... 315/307
2002/0017881 A1 * 2/2002 Szabados ..... 315/312
2008/0129220 A1 * 6/2008 Shteynberg et al. ..... 315/291

* cited by examiner

*Primary Examiner*—David Hung Vu
*Assistant Examiner*—Tung X Le
(74) *Attorney, Agent, or Firm*—Baker & McKenzie LLP

(57) ABSTRACT

The present invention is directed to an apparatus that drives a lighting system with multiple lamps. A phase shift mechanism is produced either by a digital method, an analog method, or a mixture of the two methods. In a digital method, phase shifts are generated by digital circuits comprising counters, a divider, an adder, and a comparator. The digital circuits analyze the signal and use the necessary information to form a series of phased driving signals. In an analog method, phase shifts are generated by analog circuits comprising ramp waveform generators, comparators, and at least one shot generator. Also, an apparatus for driving a lighting system with multiple lamps can be realized by mixing the two methods mentioned above.

17 Claims, 4 Drawing Sheets

CONTROL SYSTEM FOR MULTIPLE FLUORESCENT LAMPS

FIELD OF THE INVENTION

This invention relates to a control system of multiple switching power supplies and specifically, to a controller of multiple switching power supplies or converters capable of providing regulated power to cold cathode fluorescent lamps (CCFL).

BACKGROUND OF THE INVENTION

The common backlight source for LCD is a cold cathode fluorescent lamp (CCFL). The CCFL is a discharge lamp composed of low-pressure mercury. Since the CCFL does not have the filaments that emit light with heat, it has longer lifetime and consumes less power than typical hot-cathode type lamps. As the size of the LCD flat panel increases, multiple CCFL lamps are required in order to provide sufficient backlight. Accordingly, it is important that the driving current is maintained within a reasonable tolerance range, 6 mArms +/−5% (or +/−0.3 mArms).

U.S. Pat. No. 6,879,114 to Jales et al., titled "Fluorescent lamp driver circuit", discloses a driver circuit for controlling a plurality of fluorescent lamps and a plurality of transformers. However, a plurality of simultaneous switch-on and/or switch-off signals consume a great amount of power and create ripples in the power source. Therefore, the whole system may be unstable due to these "power noises". The disclosure of this invention is herein incorporated by reference.

A solution to the above problem is to use a control system to coordinate the operations of switch-on and/or switch-off signals. U.S. Pat. No. 6,778,415 to Lin, titled "Controller electrical power circuit supplying energy to a display device", discloses a controller which controls at least two power inverters comprising a pulse generator and a selector. The pulse generator generates a pulse signal to trigger the first power inverter. Then, another pulse signal is passed to the next power inverter by the first power inverter. The selector generates a reference voltage for those power inverters. The controller is used to provide phase shifts to the power inverters. Through the phase shift signals that are sequentially transported by each power inverter, the frequency of the periodic phase shift signals is reduced by the factor of the number of the power inverters. However, the selector circuit utilizing a superposition method based on the values of an input voltage, a reference voltage and three resistors causes higher power consumption and interferences between the regulator, the input circuit, and the output circuit. The disclosure of this invention is also incorporated herein by reference.

U.S. Pat. No. 6,707,264 to Lin et al., titled "Sequential burst mode activation circuit", discloses a sequential burst mode activation circuit comprising a pulse modulator, a frequency selector, and a phase delay array. This circuit is mainly used for the dimming function of a plurality of fluorescent lamps. A plurality of phased pulse width modulation (PWM) signals is used to regulate the power of respective loads such that at least two loads do not turn on concurrently. However, the phase array that comprises a selection of circuitries, phase delay generators and phased burst signal generators, complicates the whole driving system of the fluorescent lamps. Thus, there is still room for improvement. The entire disclosure of this invention is also incorporated herein by reference.

FIG. 1 describes the pulse width modulation (PWM) signals for driving the inverter of the fluorescent lamps in the prior art. For example, there are two switches in an inverter of fluorescent lamps, i.e. a push-pull inverter. The push-pull inverter, which is also called push-pull converter, switches on one of the two transistors Q1 and Q2 alternately to cause a transformer core to change voltage polarity. Another type of inverter, called half-bridge inverter, uses two transistors to implement the power circuit design. In FIG. 1, a positive driving signal 11 and a negative driving signal 12 are in the form of periodic waveforms. They drive the transistor Q1 and Q2 respectively. In a push-pull design, if the transistor Q1 is a PMOS, then the transistor Q2 may be an NMOS. On the contrary, if the transistor Q1 is an NMOS, then the transistor may be a PMOS. This is the same if the bipolar junction transistors (BJT) are used. Thus, the driving signal 11 is necessary to switch on the NMOS while the driving signal 12 is to switch off the PMOS. Furthermore, the driving signal 11 is necessary to switch off the NMOS while the driving signal 12 is to switch on the PMOS. For a multiple lamps system, the signal 13 and signal 15 perform similar functions as the driving signal 11. The signal 14 and signal 16 perform the same function as the driving signal 12. In another aspect, only one PWM signal, i.e. signal 11, is used to drive a power circuit of fluorescent lamps when a class E amplifier is employed in the circuit design. Thus, the signals 11, 13 and 15 are sufficient to drive a plurality of fluorescent lamps.

Alternating current created by the resonance of a transformer is usually used to drive a fluorescent lamp. In a power inverter design, one or more transistors are employed to correct the resonant frequency of the transformer by charging the magnetic core from the power supply or discharging the magnetic core to the ground. The PWM signals mentioned above are used to control the charge and/or discharge operations of the power inverter. As a result of the charge and discharge operations, the current reaches a maximum value when the power source provides current to charge the core of the transformer, and reaches a minimum value when the transistor discharges the core where no current is consumed. The waveforms 18, 19 and 110 represent the current consumption of each fluorescent lamp in a multiple lamps system. The waveform 17 represents the total current consumption of the waveforms 18, 19 and 110. As the number of lamps used in a lighting system increases, the difference between the maximum and the minimum value of the total current consumption also increases. This phenomenon causes the system to be unstable especially in a mobile system where the power source is from a battery.

SUMMARY OF THE INVENTION

The present invention is directed to an apparatus which addresses the limitations of the simultaneously switching-on or switching-off operations of a lighting system that controls a plurality of inverters and lamps. An advantage of the present invention is to provide a cost effective control system with flexible configurations capable of generating phase shift signals to a plurality of inverters for multiple fluorescent lamps.

To achieve the advantage of the present invention, a control system for multiple lamps which can be realized in two aspects is described herein. In the digital aspect, a control system for multiple fluorescent lamps comprises a period counter, a divider, a pulse width counter, an adder, and a comparator. The period counter receives a pulse width modulation (PWM) signal as input and evaluates the period information of said PWM signal. The divider receives the period information of said PWM signal and divides the period information by a number N. The pulse width counter receives the PWM signal as input and evaluates the pulse width of said PWM. The adder sums up a signal from the divider containing the period information of the PWM signal with a signal from the pulse width counter containing the pulse width information, and outputs the total value. The comparator receives 1) a value of end point from the adder; 2) period counting information from the period counter; and 3) a value of start point from the divider. The comparator then outputs phased PWM signals by comparing the end point, the start point, and the period counting information.

In the analog aspect, a control system for multiple fluorescent lamps of the invention comprises a fundamental ramp waveform generator, a plurality of reset comparators, a plurality of one shot generators, a plurality of ramp waveform generators and a plurality of PWM comparators. The fundamental ramp waveform generator generates a ramp waveform with fixed frequency. Each reset comparator receives the ramp waveform from the fundamental ramp waveform generator as an input, and also a reset reference voltage as another input. Each one shot generator detects either the rising edge or the falling edge, and also outputs a shot pulse as a reset signal. Each ramp waveform generator generates a ramp waveform reset by the signal from the one shot generator. And each PWM comparator compares the ramp waveform generated from said ramp waveform generator to a PWM reference voltage, and outputs the PWM signals with phase shifts.

Moreover, a control system for multiple fluorescent lamps in the form of a mixed type is also possible according to the present invention. A control system for multiple fluorescent lamps comprises a period counter, a divider, a pulse width counter, an adder, a comparator, a plurality of ramp waveform generators and a plurality of PWM comparators. The period counter receives a pulse width modulation (PWM) signal as input and evaluates the period information of said PWM signal. The divider receives the period information of said PWM signal and divides the period information by a number N. The pulse width counter receives the PWM signal as input and evaluates the pulse width of said PWM. The adder sums a signal from the divider containing the period information of the PWM signal with a signal from the pulse width counter containing the pulse width information, and then outputs the total value. The comparator receives 1) a value of end point from the adder; 2) period counting information from the period counter; and 3) a value of start point from the divider. Then, the comparator outputs phased PWM signals by comparing the end point, the start point, and the period counting information. Each ramp waveform generators generates a ramp waveform that is reset by the reset signal. Each PWM comparator compares the ramp waveform generated from said ramp waveform generator with a PWM reference voltage, and then outputs the PWM signals with phase shift.

DESCRIPTION OF EMBODIMENTS OF THE INVENTION

Figure 1:
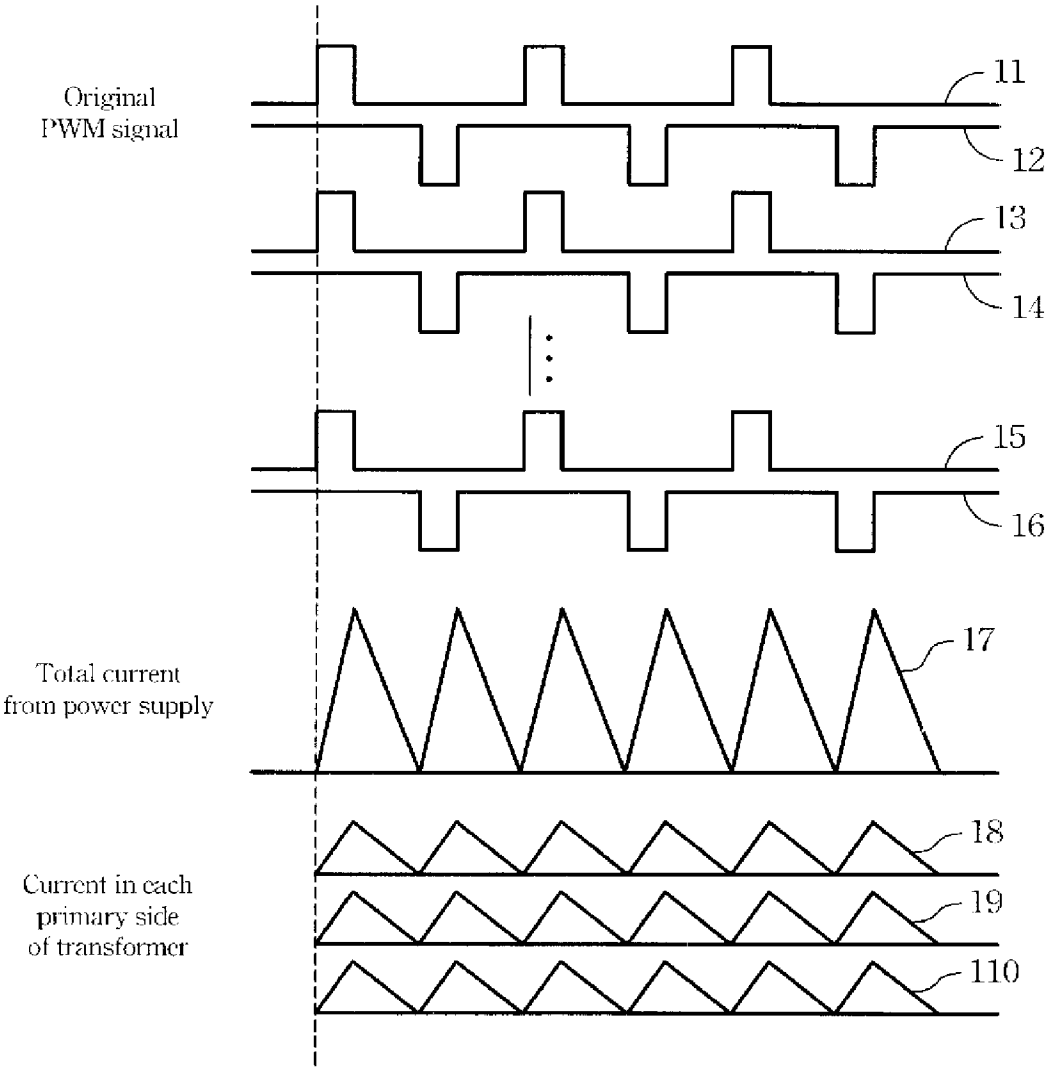
FIG. 1 (Prior Art)
FIG. 1 illustrates the signals used in the conventional driving apparatus of fluorescent lamps.
Figure 2:
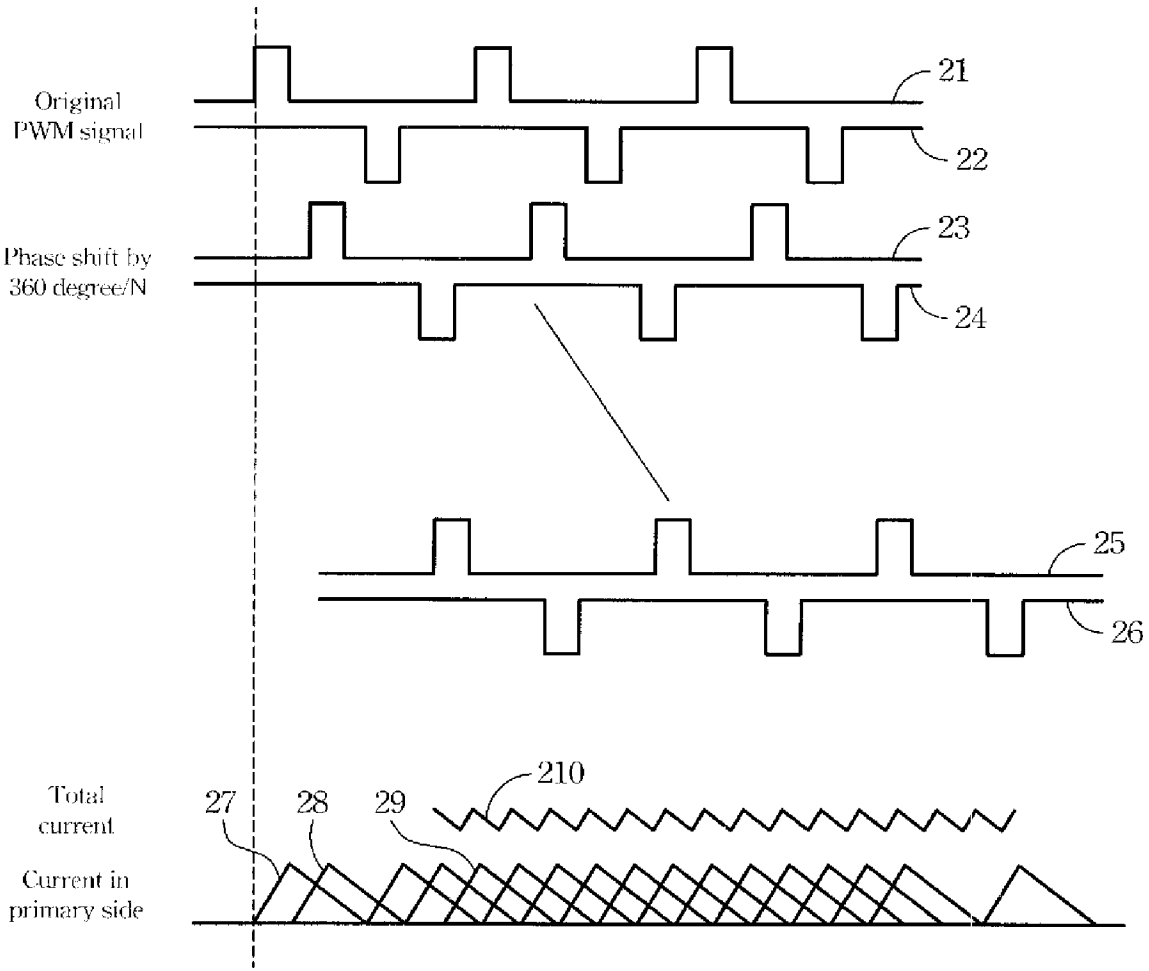
FIG. 2 illustrates the signals used in the driving apparatus of fluorescent lamps according to the present invention.

FIG. 2 illustrates the signals where the current consumption is averaged out in time. The waveforms 21, 23 and 25 illustrate the driving signals for NMOS or N-type BJT transistor. The waveforms 22, 24 and 26 illustrate the driving signals for PMOS or P-type BJT transistor. There is a phase shift between the driving signals, i.e. the driving signal 21 and driving signal 23. The phase shift is 360/N degree for an N-lamp system. Alternatively, the phase shift may be 360/M for an N-lamp system where M is an integer. The waveforms 27, 28 and 29 illustrate the current consumptions induced by the driving signal pair 21, 22, the driving signal pair 23, 24, and the driving signal pair 25, 26, respectively. The sum of these current consumptions is illustrated by the waveform 210, which is smoother than the waveform 17 in FIG. 1. Thus, the peak current induced by the driving signals 21~26 is much smaller than that induced by the driving signals 11~16. It should be noted that the number of signal pairs is not limited by the pictorial description herein.

Although the phase shift technique has been employed in several power inverter designs, there are still rooms for improvement. The present invention provides a digital and an analog method to implement the phase shift mechanism which can produce a system that is cost effective and has fewer components. The digital method utilizes a digital circuit to construct a module whose function is to provide a plurality of phased periodic PWM signals. The digital circuit is further controlled by precise timing and by several additional parameters to modify the phase delay between different driving signals. The digital means can provide users with friendly operational interface which is very important in the field of consumer electronic products. The digital means has the advantage of a module-based design method which can accelerate chips development process and shorten the time to market. Beside the digital method, an analog method can also be applied in order to drive a lighting system used in a large panel or in a harsh environment. Using the analog method, a driving system that supports high voltage and high current in order to obtain good quality illumination can be achieved.

Figure 3:
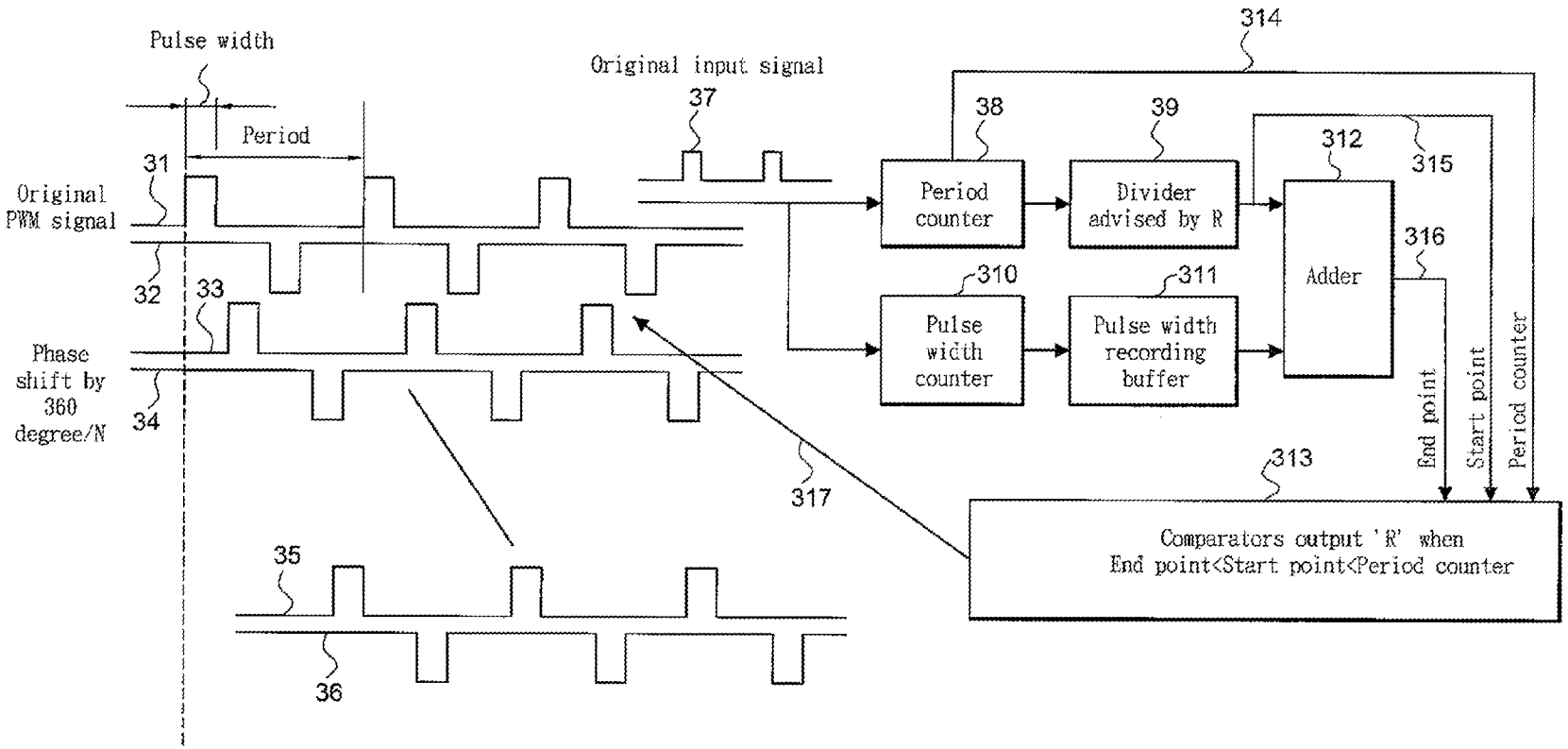
FIG. 3 is a block diagram illustrating a digital method according to the invention.

FIG. 3 illustrates an embodiment according to the present invention that generates a phase shift. In this embodiment, several digital circuits are used. The digital circuits include counters, a divider, an adder, and a comparator. As an option, a buffer can be used in this embodiment. For those skilled in the art, these digital circuits are commonly used in the industry. Therefore, the details of these functional blocks are not explained herein.

This embodiment uses a digital scheme to add a phase shift to an original input signal 37, wherein the digital scheme comprises a period counter 38, a divider 39, an adder 312, a pulse width counter 310, a pulse width recording buffer 311 and a comparator 313. The original input signal 37 can be a signal with various waveforms. For example, a periodic square waveform 31 is depicted in FIG. 3. It is possible to use other waveforms with different shapes. The periodic square waveform 31 has a period T. In order to illustrate the phase shift created by this digital scheme, the first pulse of the periodic square waveform 31 begins at time t=0. It is easy to see that outputs 33~36 are generated by the digital scheme. The waveform of the output 31 has the same period T and a phase delay when compares to the waveform of the first pulse 33.

The operation of the digital scheme is described herein. First, the original input signal 37 is sent to the period counter 38 where the period of the input signal 37 can be determined the pulse width recording buffer 311 can be used to record and buffer the pulse width of output signal 37 received from the period counter 38. In the interim, the input signal 37 is also sent to the pulse width counter 310 where the pulse width of the input signal 37 can be counted based on a specific frequency or a specific clock. Second, the divider 39 divides the period of the input signal 37 according to a predetermined parameter. In one embodiment, the predetermined parameter is the number of the fluorescent lamps. The divider 39 can calculate the necessary phase shift between the output signal and the input signal 37. In other embodiments, the predetermined parameter can be changed. Therefore, users can modify the digital scheme to obtain an appropriate phase shift. Moreover, users can change the parameter to adapt the digital scheme to various environmental factors. Third, the adder 312 adds the necessary phase shift to the pulse width of the input signal 37 to generate an end indicator.

Finally, a phase delay signal can be obtained by using the above digital blocks. A comparator 313 receives (1) the period information 314 from the period counter 38, (2) a start indicator 315 from the divider 39 and (3) the end indicator 316 from the adder 312. After the comparison performed by the comparator 313, the comparator 313 can generate a phase delay output signal 317. For example, the comparator 313 may output high when the start indicator is less than the period and the end indicator is greater than the period. Otherwise, the output 317 keeps low active. In an alternative embodiment, the comparator 313 may output low when the start indicator is greater than the period and the end indication is less than the period. Otherwise, the output 317 keeps high active.

It is possible to expand the digital scheme to generate a series of phase delayed signals. It is also possible to adjust the phase shift according to different conditions to those skilled in the art. Thus, various modifications apply to the digital scheme should still fall within the scope of the present invention.

Figure 4:
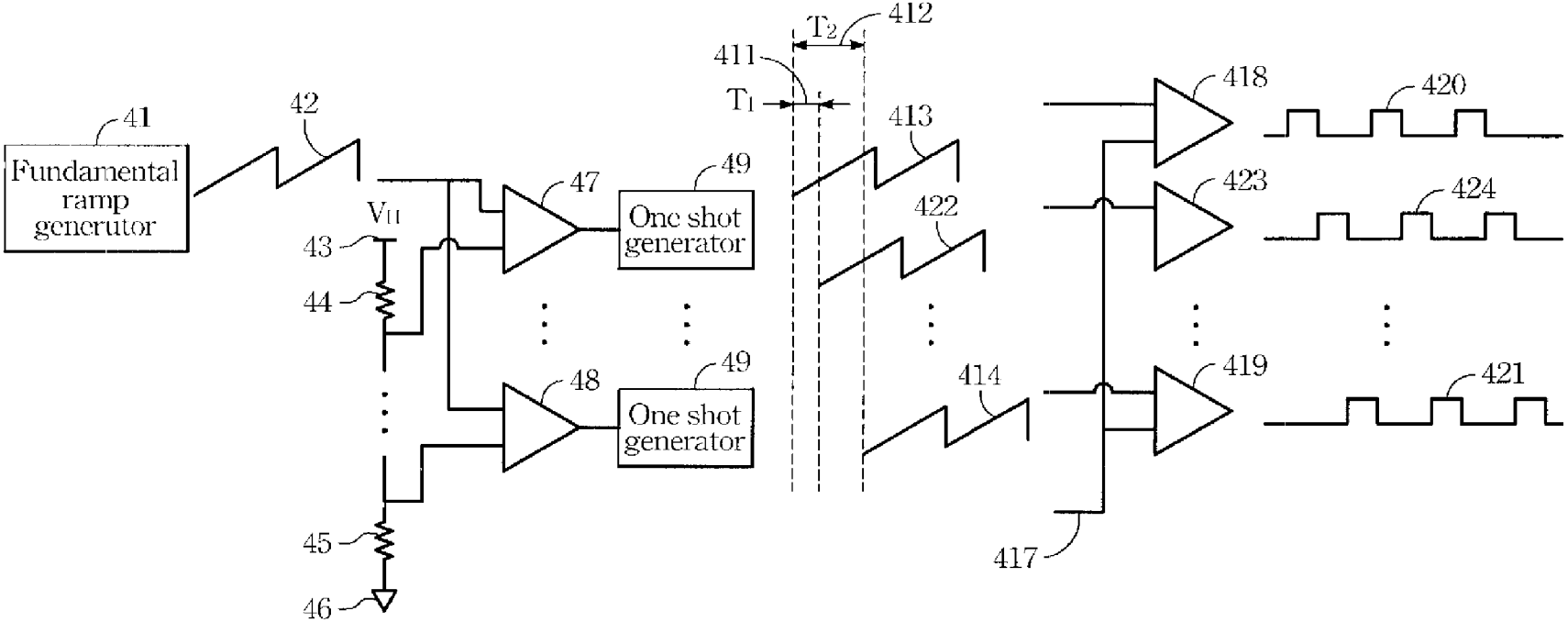
FIG. 4 is a block diagram illustrating an analog method according to the invention.

FIG. 4 illustrates another embodiment of the present invention with an analog scheme. The analog scheme uses several analog circuits instead of digital circuits. The analog circuits includes ramp wave generators, comparators, one shot generators, and several resistors. The mentioned comparator here is an analog comparator. For those skilled in the art, the analog circuits used here are common in the industry. Therefore, the details of the analog circuits are omitted herein.

In this embodiment, an analog scheme comprises a first ramp wave generator 41, a first set of comparators 47, 48 one shot generators 49, a second ramp wave generator (not shown in the figure), a second set of comparators 418, 423, . . . , 419 and two resistors 44, 45. The ramp wave generator 41 generates a ramp wave 42 having a period T. In the figure, the dotted line indicates the ramp wave 413 staffs at time t=0. This starting time is the same for the output 420 such that a generated phase shift can be clearly illustrated.

Before the first set of comparators 47, 48 compare the ramp wave 42, a predetermined voltage is created by the resistors 44, 45. For example, a specific voltage VH is coupled to the resistor 44, and a ground is coupled to the resistor 45. A reference voltage in the range between the voltage VH and the ground can be determined. The reference voltage can also be adjusted by changing the resistance of the resistors 44, 45. The reference voltage is used to determine how much phase shift will be generated, which is similar to the staff indicator in the digital scheme.

The first set of comparators 47, 48 compares the voltage of the ramp wave 42 to the reference voltages first, and then generate the comparison results to the one shot generators 49. The comparison operation may be configured in such manner that it generates either a high voltage level when the ramp wave 42 is greater than the reference voltage; or a low voltage level when the ramp wave 42 is lower than the reference voltage. Therefore, the phase delay information can be determined when the outputs of the first set of comparators 47, 48, create voltage jumps, e.g., positive edges.

The one shot generators 49 can generate pulses when detecting signal edges from the first set of comparators 47, 48. These pulses act as reset signals to the second ramp wave generators. The second ramp wave generators use these reset signals to decide the starting point of the ramp waves. Accordingly, a set of phase delayed ramp waves 413, 422, . . . , 414 are generated wherein the phase delayed is determined by changing the reference voltage.

Finally, the second set of comparators 418, 423, . . . , 419 compare the phase delayed ramp waves 413, 422, . . . , 414 to a second reference voltage Vref 417. A set of periodic square waves 420, 424, . . . , 421 with a desirable pulse width can be generated from the outputs of the second set of comparators 418, 423, . . . , 419. For example, the second set of comparators 418, 423, . . . , 419 may output high when the voltages of the phase delayed ramp waves 413, 422, . . . , 414 are lower than that of the second reference voltage Vref 417. Otherwise, when the voltages of the phase delayed ramp waves are higher than that of Vref, the second set of comparators will output low. If the pulse width is not wide enough, the voltage level of the second reference voltage Vref may be changed to a higher level.

The analog scheme in FIG. 4 is for illustration only. Another analog scheme according to the present invention may output a series of phase delayed signals to avoid simultaneous ON or OFF status in a control system for multiple fluorescent lamps. For those skilled in the art, it is possible to modify the voltage levels in the analog scheme for various applications.

According to an alternative embodiment of the present invention, it can combine both the digital and analog schemes as shown in FIGS. 3 and 4. In other words, the control system comprises the digital part such as a period counter 38, a divider 39, an adder 312, a pulse width counter 310, a pulse width recording buffer 311, and a comparator 313, as well as the analog part such as a first ramp wave generator 41, a first set of comparators 47, 48, one shot generators 49, a second ramp wave generator, a second set of comparators 418, 423, . . . , 419, and two resistors 44, 45.

It will be apparent to those skilled in the art that various modifications can be made to the present invention without departing from the scope of the invention. For example, the reference voltages may be generated by regulators instead of a chain of resistors. Moreover, the one shot generator may comprise a delay circuit and a logic circuit.

What is claimed is:

1. A control system for multiple fluorescent lamps, comprising:

a period counter that receives a signal and calculates the period of said signal;

a divider that receives said period and divides said period by a predetermined number to form a start point indicator;

a pulse width counter that receives said signal and calculates the pulse width of said signal;

an adder that adds the divided period from said divider to said pulse width to form an end point indicator; and a comparator that outputs a phase delayed signal by comparing said start point indicator, said end point indicator, and said period.

2. A control system for multiple fluorescent lamps according to claim 1, further comprising a pulse width recording buffer that memorizes the pulse width of said periodic signal received by said period counter.

3. A control system for multiple fluorescent lamps according to claim 1, wherein said predetermined number is a positive integer.

4. A control system for multiple fluorescent lamps according to claim 3, wherein said predetermined number is a positive integer equal to the number of the fluorescent lamps.

5. A control system for multiple fluorescent lamps according to claim 1, wherein said comparator outputs high when the value of said period is (1) larger than and/or equal to the value of said start point indicator and (2) lesser than and/or equal to the value of the end point indicator.

6. A control system for multiple fluorescent lamps according to claim 1, wherein said comparator outputs low when the value of said period is (1) lesser than and/or equal to the value of said start point indicator, or (2) larger than and/or equal to the value of said end point indicator.

7. A control system for multiple fluorescent lamps according to claim 1, wherein the comparator outputs low when the value of said period is (1) larger than and/or equal to the value of said start point indicator, and (2) lesser than and/or equal to the value of said end point indicator.

8. A control system for multiple fluorescent lamps according to claim 1, wherein the comparator outputs high when the value of said period is (1) lesser than and/or equal to the value of said start point indicator, or (2) larger than and/or equal to the value of said end point indicator.

9. A control system for multiple fluorescent lamps, comprising:

a period counter that receives an input signal and calculates the period of said input signal;

a divider that receives the period of said input signal and divides said period by a predetermined number to form a start point indicator;

a pulse width counter that receives said input signal and calculates the pulse width of said signal;

an adder that adds the divided period from said divider to said pulse width to form an end point indicator;

a first comparator that outputs a phase delayed signal by comparing said start point indicator, said end point indicator, and said period;

a ramp waveform generator that generates a ramp waveform signal according to a reset signal; and a second comparator that generates an output signal with a phase shift by comparing said ramp waveform signal to a reference voltage.

10. A control system for multiple fluorescent lamps according to claim 9, further comprising a pulse width recording buffer that memorizes the pulse width from said pulse width counter.

11. A control system for multiple fluorescent lamps according to claim 9, wherein said predetermined number is a positive integer.

12. A control system for multiple fluorescent lamps according to claim 11, wherein the predetermined number is a positive integer equal to the number of the fluorescent lamps.

13. A control system for multiple fluorescent lamps according to claim 9, wherein said first comparator outputs high when the value of said period is larger than and/or equal to the value of said start point indicator, and lesser than and/or equal to the value of the end point indicator.

14. A control system for multiple fluorescent lamps according to claim 9, wherein said first comparator outputs low when the value of said period is lesser than and/or equal to the value of said start point indicator, or larger than and/or equal to the value of the end point indicator.

15. A control system for multiple fluorescent lamps according to claim 9, wherein said reference voltage is generated by a regulator.

16. A method for controlling a system with multiple fluorescent lamps, comprising the steps of:

generating a ramp waveform signal;

extracting the period and the width of said ramp waveform signal;

calculating a start point indicator by dividing the period by a predetermined number;

adding the value of said start point indicator to the width of said ramp waveform signal to form an end point indicator; and comparing said start point indicator, said end point indicator, and said period in order to generate a series of output signals with phase shifts.

17. A method for controlling a system with multiple fluorescent lamps according to claim 16, further comprising the step of:

recording and buffering the width of said ramp waveform signal.

* * * * *